US009789985B2

(12) United States Patent
Winkler et al.

(10) Patent No.: US 9,789,985 B2
(45) Date of Patent: Oct. 17, 2017

(54) PACKAGING AID, PACKING METHOD AND PACKING WORKPLACE

(71) Applicant: SSI SCHAFER PEEM GMBH, Graz (AT)

(72) Inventors: Max Winkler, Graz (AU); Elmar Issing, Giebelstadt (DE)

(73) Assignee: SSI SCHÄFER PEEM GMBH, Graz (AT)

( * ) Notice: Subject to any disclaimer, the term of this patent is extended or adjusted under 35 U.S.C. 154(b) by 0 days.

(21) Appl. No.: 15/225,948

(22) Filed: Aug. 2, 2016

(65) Prior Publication Data

US 2016/0340067 A1 Nov. 24, 2016

Related U.S. Application Data

(63) Continuation of application No. PCT/EP2014/074499, filed on Nov. 13, 2014.

(30) Foreign Application Priority Data

Feb. 3, 2014 (DE) ..... 10 2014 101 268
Nov. 13, 2014 (WO) ..... PCT/EP2014/074499

(51) Int. Cl.
*B65B 35/50* (2006.01)
*B65B 43/08* (2006.01)
(Continued)

(52) U.S. Cl.
CPC ..... *B65B 35/50* (2013.01); *B65B 7/16* (2013.01); *B65B 11/004* (2013.01); *B65B 39/02* (2013.01);
(Continued)

(58) Field of Classification Search
CPC ..... B65B 35/50; B65B 7/16; B65B 11/004; B65B 39/02; B65B 43/08; B65B 57/12;
(Continued)

(56) References Cited

U.S. PATENT DOCUMENTS 856,445 A * 6/1907 Coffman ..... B30B 9/3014 100/218
2,688,878 A * 9/1954 Kolisch ..... G01F 17/00 177/25.15
(Continued)

FOREIGN PATENT DOCUMENTS

DE 103 00 164 A1 7/2004
DE 69730758 T2 9/2005
(Continued)

OTHER PUBLICATIONS

International Search Report and Written Opinion for corresponding Patent Application No. PCT/EP2014/074499 dated Apr. 1, 2015.

*Primary Examiner* — Hemant M Desai
*Assistant Examiner* — Lucas Palmer
(74) *Attorney, Agent, or Firm* — Renner, Otto, Boiselle & Sklar, LLP

(57) ABSTRACT

It is disclosed a packing-work station for packing articles, which belong to one picking order, into shipping units comprising: a packing device comprising a packing plane where the articles are stackable to an article stack; a stacking aid having a plurality of lateral sides against which the articles are positioned to form the article stack, wherein the stacking aid is configured to be positioned on the packing plane; and a measuring device for determining dimensions of the article stack in order to individually produce the shipping unit in accordance with the so-determined dimensions; wherein the lateral sides of the stacking aid, which are closed in a circumferential direction of the stacking aid, are connected to each other; wherein the lateral sides define an open bottom side as well as an open top side of the stacking aid, wherein the lateral sides are adjustable in length at least along the circumferential direction for positioning the lateral sides circumferentially compact against the article stack; and wherein the measuring device is configured to measure a
(Continued)

length of the lateral sides of the stacking aid as well as to determine a maximum height of the article stack and the measured lengths as well as to transmit the so-determined height to a package-production device which produces the shipping unit in accordance with the measured lengths and the determined height.

11 Claims, 6 Drawing Sheets

(51) Int. Cl.

| | |
|---|---|
| ***B65B 59/00*** | (2006.01) |
| ***B65B 7/16*** | (2006.01) |
| ***B65B 39/02*** | (2006.01) |
| ***B65B 57/12*** | (2006.01) |
| ***B65B 11/00*** | (2006.01) |
| *B65B 67/10* | (2006.01) |

(52) U.S. Cl.
CPC ..... *B65B 43/08* (2013.01); *B65B 57/12* (2013.01); *B65B 59/00* (2013.01); *B65B 67/10* (2013.01); *B65B 2210/04* (2013.01)

(58) Field of Classification Search
CPC ..... B65B 59/00; B65B 67/10; B65B 2210/04; B65B 39/002; B65B 39/00; G01B 3/14; G01B 5/00
USPC ..... 53/503, 504, 66, 540, 390, 393; 294/87.1; 705/414; 33/1 V, 121, 501.45, 33/562
See application file for complete search history.

(56) References Cited

U.S. PATENT DOCUMENTS 2,969,629 A * 1/1961 Blais ..... B65B 5/061 206/38
4,094,130 A * 6/1978 Kelly ..... B30B 9/30 100/215
4,098,051 A * 7/1978 Cordes ..... B65B 53/02 53/258
4,564,593 A 1/1986 Tsukamoto et al.
4,679,379 A * 7/1987 Cassoli ..... B65B 9/073 100/232
5,016,753 A * 5/1991 Henderson ..... B65D 5/0005 116/306
5,052,167 A * 10/1991 Scharch ..... B65B 19/34 198/761
5,056,667 A * 10/1991 Coogan ..... B65D 19/12 206/600
5,127,212 A * 7/1992 Johnsen ..... B65B 35/50 193/2 C
5,170,610 A * 12/1992 Tisma ..... B65B 35/205 53/260
5,908,283 A * 6/1999 Huang ..... B65G 47/90 414/21
6,309,334 B1 * 10/2001 Planas Xapelli .. B65D 5/48026 493/150
6,594,970 B1 * 7/2003 Hyne ..... B65B 11/025 53/399
6,880,311 B2 * 4/2005 Winkler ..... B65B 11/025 206/597
7,143,567 B2 * 12/2006 Omo ..... B65B 25/146 414/788.4
7,263,815 B2 * 9/2007 Ballestrazzi ..... B65B 9/067 53/450
7,331,471 B1 * 2/2008 Shakes ..... B07C 7/005 209/559
7,591,124 B2 * 9/2009 Ruz ..... B65B 5/067 53/447
7,707,805 B2 * 5/2010 Gorrieri ..... B65B 11/12 53/209
8,468,781 B2 * 6/2013 Fritzsche ..... B65B 35/52 414/791.6
2004/0060264 A1 * 4/2004 Miller ..... B65B 11/18 53/461
2009/0031676 A1 * 2/2009 Boigues ..... B65B 5/02 53/491
2010/0059399 A1 * 3/2010 Peeters ..... B65D 19/20 206/451
2010/0307112 A1 * 12/2010 Andersen ..... B65B 35/20 53/397
2011/0011035 A1 * 1/2011 Praestholm ..... B30B 9/3014 53/438
2011/0206812 A1 * 8/2011 Elias ..... B65B 1/22 426/124
2013/0000252 A1 * 1/2013 Pettersson ..... B65B 5/024 53/396
2013/0212982 A1 * 8/2013 Baumann ..... B65G 1/1378 53/447
2013/0221088 A1 8/2013 Magnell
2013/0225383 A1 * 8/2013 Toro ..... B31B 17/00 493/56
2014/0174885 A1 * 6/2014 Cavelius ..... B65G 57/035 198/418.9
2014/0263351 A1 * 9/2014 Youell ..... B65D 5/48038 220/507

FOREIGN PATENT DOCUMENTS

DE 10 2010 035802 A1 3/2012
DE 10 2012 106109 A1 1/2014
EP 1 440 920 A2 7/2004
EP 2 256 043 A1 12/2010
WO WO 2009/080582 A1 7/2009
WO WO 2009/109218 A1 9/2009
WO WO 2011/072253 A1 6/2011

* cited by examiner

PACKAGING AID, PACKING METHOD AND PACKING WORKPLACE

RELATED APPLICATIONS

This is a continuation application of the co-pending international application WO 2015/113665 A1 (PCT/EP2014/074499) filed on Nov. 13, 2014, which claims priority of the German patent application DE 10 2014 101 268.2 filed on Feb. 3, 2014, both of which are incorporated herewith by reference.

BACKGROUND OF THE INVENTION

The present invention relates to a packing aid, or stacking aid, which assists a packing person upon stacking articles of one picking order and which is subsequently used, at least temporarily, during a process where a shipping carton is produced, dimensions of which are individually adapted to the article stack generated by the packing person. The invention further relates to a corresponding packing method as well as to a correspondingly equipped packing-work station, and a storage and picking system.

RELATED PRIOR ART

The document DE 103 00 164 A1 discloses a method and device for packing piece-good articles. The document DE 697 30 758 T2 discloses a method and device for palletizing packing goods having arbitrary dimensions and arbitrary weights. The document WO 2009/109218 A1 discloses a method as well as a work station for semi-automated multi-layer stacking onto a load support. The document U.S. Pat. No. 4,564,593 A discloses a method for forming and fixing a pouch stack.

Due to an increased availability of (consumer) goods in the light of a globalized market and due to the e-commerce the number of consignments of goods recently has increased steadily. Retailers typically ship the ordered articles to their customers in shipping cartons having prefabricated sizes. The cartons are prefabricated with regard to their dimensions (height, width, length) thereof. So far shipping costs have been determined substantially by weight of the consignment of goods. Recently, the shipping costs are also increasingly determined in a volume-dependent manner, i.e. no longer weight dependent. Consequently there are efforts to adapt as good as possible a size of shipping units and shipping cartons, respectively, to a volume of the ordered articles, in order to avoid unused voids (air) in the interior of the shipping cartons. Since packing volume always depends on the volume of the ordered articles utilization of prefabricated cartons has disadvantages. Therefore, in former days, machines had already been developed which allowed on-demand production of packages having individualized dimensions in a fast and timely manner. Providers of such machines are, amongst other things, the companies Packsize, T-ROC Equipment, and Packaging Sales & Consulting. A machine of this type is exemplarily described in the document WO 2011/072253 A1.

In practice the articles belonging to the one picking order are moved in the storage and picking system to a picking and packing work station where the articles are manually stacked by a human to form an article stack. Minimal shipping volume (pre-determinable computationally) results from the sum of the volumes of the individual articles belonging to the picking order provided that the single volumes are stored in terms of data. However, this minimal volume will never be reached during stacking and packing because the articles will never be stacked densely, i.e. without air between them. In addition, there are many different possibilities for the packing person to pack the articles of the picking order for forming an article stack. For example, this depends on the articles which are arranged at the bottom and on the articles which are arranged at the top of the article stack. This means with other words that the height, the width, and the length of one article stack can vary because the packing person is free to stack the articles of the order. Of course, the packing person will always try to pack the articles as compact as possible. Studies prove that an air fraction within shipping cartons is 40% in average. This is extremely disadvantageous if the shipping costs depend on volume.

Dimensions of an article stack can be determined in different ways. The article stack be scanned completely, for example, by means of a 3D scanner. Alternatively, individual measurements (height, width, and length) can be performed. The so-determined dimensions are than transmitted to a package-production machine producing the shipping carton in an automated manner which have the desired dimensions.

WO 2012/082980 A1 shows a hand-held unit for measuring the dimensions of individual articles or an article stack. The hand-held unit comprises a reflection-distance measuring unit as well as a contact angle being fixedly connected thereto. The contact angle is brought into contact with the article stack. Distance relative to an oppositely arranged stopper is determined. The stopper can be an integral component of a packing table and, for example, project upright from a packing surface of the table. The to-be-measured article is fixed during the measurement between the stopper and the hand-held unit, or the angle of the hand-held unit. The stopper can comprise two sides connected perpendicularly to each other which form a three dimensional rectangular angle together with the packing surface, i.e. they form a spatial corner for contacting the articles or the article stack.

SUMMARY OF THE INVENTION

It is an object of the present invention to provide an improved packing-work station and an improved packing method.

According to a first aspect of the invention it is disclosed a packing-work station for packing articles belonging to one picking order into a shipping unit, in particular into a shipping carton, comprising: a packing device which comprises a, preferably horizontally orientated, packing plane on which the articles are stackable to form an article stack; a stacking aid having several lateral sides which can be brought into contact with the articles for forming the article stack, wherein the stacking aid can be positioned on the packing plane; and a measuring device for determining dimensions of the article stack in order to individually produce the shipping unit in accordance with the so-determined dimensions; characterized in that the lateral sides of the stacking aid are connected to each other in a closed manner along a circumferential direction of the stacking aid, that the lateral sides define an open bottom side as well as an open top side of the stacking aid, wherein, preferably each of, the lateral sides are adjustable in length at least along the circumferential direction for positioning the lateral sides circumferentially compact against a stacked article stack; and that the measuring device is configured to measure a length, preferably of each, of the lateral sides of the stacking aid as well as to determine a maximum height of the article stack and the measured lengths as well as to transmit the so-determined height to a package-production device which produces the shipping unit in accordance with the measured lengths and the determined height.

The present invention is used particularly in the field of e-commerce. There, as a rule, less than five articles are ordered which partially have dimensions differing very strong. Overall volume of the articles is relatively small. However, again and again different constellations of articles are ordered so that the utilization of prefabricated shipping cartons is not optimal if shipping costs depend on volume. The present invention allows achieving an optimal packing size. In particular, humans pack the articles into the stacking aid intuitively. The stacking aid preferably has the shape of a basket being open at the top and the bottom. The stacking aid preferably is made of plastic. The lateral sides of the stacking aid can be pushed together according to an individual package dimension. In this manner package sizes can be achieved as small as possible. Dispatch papers and advertising material can be added without problems.

The stacking aid assists the formation of an optimal packing since support is provided from each of the (four) sides. The article stack can no longer collapse or skid at an open side. Nevertheless the stacking aid including the article stack can be moved due to the open bottom side. Thus, it is possible to move the stacking aid including the article stack onto an individually produced package blank, to assemble the package blank around the stacking aid, and to extract subsequently the stacking aid from the half-finished shipping carton. Thereafter the shipping carton can be closed finally. If desired, additional adding materials can be added in advance. Alternatively, for example, packing onto a thin support board can be done which board is then transferred together with the article stack from this manual work station to a carton machine. This means that the support board is moved together with the article stack positioned thereon onto a flat package blank, the support board is then laterally extracted, and then the corresponding parts of the package blank are folded upwards.

Filling and packing material can be saved in a significant scope. Within the shipping containment the articles are secured against displacement so that damages during transportation can be avoided. Nowadays, the package generally is an important advertising media, and is becoming more and more high-graded in the field of e-commerce so that the package represents a cost factor. The present invention helps saving package material, and thus to save costs.

With a preferred embodiment at least one of the lateral sides, preferably each, further is adjustable in height and the measuring device is additionally configured to measure a height of the height-adjustable lateral sides in order to determine from the measured height of the lateral sides the maximum height of the article stack.

The lateral sides can also comprise openings, preferably vertical slots through which the height of the article stack can be determined from the outside, for example, by means of optical measuring methods. Therefore, the step of adjusting the height of the lateral sides can be omitted.

Due to the height-adjustable lateral sides of the stacking aid article stacks can be formed having arbitrary heights. Thus, the stacking aid is not only adjustable to the individual article stack in the circumferential direction, but also in the height direction. It is prevented that the articles can laterally drop if the article stack is high. Further, the height of the stacked article stack can be measured easily by adapting the height-adjustable sides to the maximum height of the article stack, for example, by extending or pushing them together, and subsequently measuring the same.

Further, the lateral sides preferably form an upper and lower surrounding edge of the stacking aid, wherein the upper and/or the lower edge is provided with markers at intersection points of the lateral sides.

The marker assists in measuring the length of the sides, in particular if a camera system is used which can be arranged perpendicular above the stacking aid. A relatively costly image evaluation can be omitted. The determination of points within an image is very simple. The distance between the points can be determined easily. The length of the lateral sides results from the distance of points.

In particular exactly four lateral sides are provided surrounding the bottom side and the top side, preferably rectangular.

Nowadays most of the shipping cartons have the shape of a rectangular parallelepiped. Only in cases when very specific articles are shipped, which comprise a very specific geometry, one exceptionally deviates from the rectangular parallelepiped shape. Therefore, the stacking aid is formed of preferably four lateral sides, wherein adjacent sides define a right angle.

With another advantageous embodiment the lateral sides are connected pivotally to each other.

In this manner it is possible to fold the lateral sides onto each other, in an unused state of the stacking aid, in a space-saving manner.

With a particular embodiment each of the lateral sides comprises a, preferably linear, guidance as well as at least two wall elements which are supported in each other in the guidance in a length-adjustable manner.

In this manner it is possible to adjust the respective lateral side with regard to its length. The wall elements are formed such that they can be retracted and extended into each other. By means of the guidance it is ensured that a predetermined geometry (e.g., rectangular parallelepiped shape) can be maintained during adaptation of the lateral sides.

Further, it is advantageous if each of the lateral sides comprises a latching mechanism for setting the respective lateral side, preferably in fixedly preset intervals, in a length thereof.

Typically, the package-production device produces the package blank in accordance with a fixedly preset grid having individual lengths. This grid is mapped by the latching mechanism. Thus, intermediate sizes are avoided which possibly might not be produced by the packaging-production device.

In particular, the lateral sides are flat planes.

Further, it is advantageous if a conveyor is additionally provided onto which the stacked article stack can be transferred together with the stacking aid and which connects the packing plane to the package-production device, wherein the conveyor is configured to move the stacked article stack together with the stacking aid onto a flat package blank forming, in a folded state, the shipping unit and comprising a bottom, sidewalls, and a cover.

This embodiment is particularly used during manual packing. The packing person does not need to move the stacking aid including the article stack manually onto the package blank. The movement happens in an automated manner. For example, this can be achieved by arranging the conveyor, on which the stacking aid including the article stack is placed, slightly higher than the provided package blank for conveying the stacking aid including the article stack onto the package blank.

With another preferred embodiment the packing-work station further comprises a package-material dispenser which is arranged adjacent to the packing device and which is configured to deliver a package-material web to the packing plane.

In this manner it is possible that the stacking aid is placed directly onto the package-material web for being filled with the articles subsequently. This simplifies the transfer of the stacking aid including the article stack onto the package blank because the package blank is made of the package-material web. The packing person merely cuts a portion of the material web on which the stacking aid including the article stack is placed before this bundle is transferred to the package-production device.

In particular, the packing-work station further comprises the package-production device.

With a preferred embodiment the packing-work station further comprises an article feed which is coupled to the package-production device for moving the article to the packing plane.

According to another aspect it is disclosed a method for packing of articles, which belong to one picking order, into a shipping unit, particularly into a shipping carton, which is produced individually for the articles of the order in a volume-optimized manner, the method comprising the steps of: moving the articles to the packing device which comprises a packing plane; positioning a stacking aid on the packing plane, wherein the stacking aid comprises a number of lateral sides which are connected to each other in closed manner in a circumferential direction of the stacking aid and define an open bottom side as well as an open top side, wherein each of the lateral sides is adjustable at least in length; stacking the article within the stacking aid on the packing area to form an article stack, which preferably is volume-optimized, by moving the articles through the open top side or bottom side and putting the same onto the packing area or onto an already stacked article as compact as possible; pushing the lateral sides together so that the lateral sides are positioned as close as possible against the article stack; measuring a length of the lateral sides of the stacking aid in the pushed together state; determining a maximum height of the article stack; producing a flat package blank which forms, in a folded state, the shipping unit, in accordance with the measured lengths and the determined height, wherein the package blank comprises a bottom, sidewalls, and a cover; providing the bottom beneath the article stack and stacking aid; erecting the sidewalls of the package blank into a position so that the sidewalls of the blank are positioned against the lateral sides of the stacking aid; connecting the erected lateral sidewalls to each other; removing the stacking aid; and closing the cover.

Preferably, the step of providing the bottom comprises: moving the article stack which is located within the stacking aid together with the stacking aid onto the bottom of the package blank.

Alternatively, the step of providing the bottom comprises: providing a package-material web on the packing plane of which the package blank is made, wherein the stacking aid is positioned on the package-material web before the articles are stacked.

Further, it is advantageous if the step of removing the stacking aid comprises: extracting the stacking aid from the sidewalls which are erected and connected to each other.

BRIEF DESCRIPTION OF THE DRAWINGS

Further, it is clear that the above-mentioned and hereinafter still to be explained features cannot only be used in the respectively given combination but also in other combinations or alone without departing from the scope of the present invention.

Embodiments of the invention are illustrated in the drawings and will be explained in more detail in the following description.

PREFERRED EMBODIMENTS OF THE INVENTION

The present invention is typically used in a storage and picking system 10, for example, in a distribution center. The storage and picking system can comprise a goods receipt, which is not shown in more detail, a (long-term) warehouse, a short-term warehouse or a buffer, one or more conveying systems, a sorter, a goods issue and/or a control 24.

Figure 1:
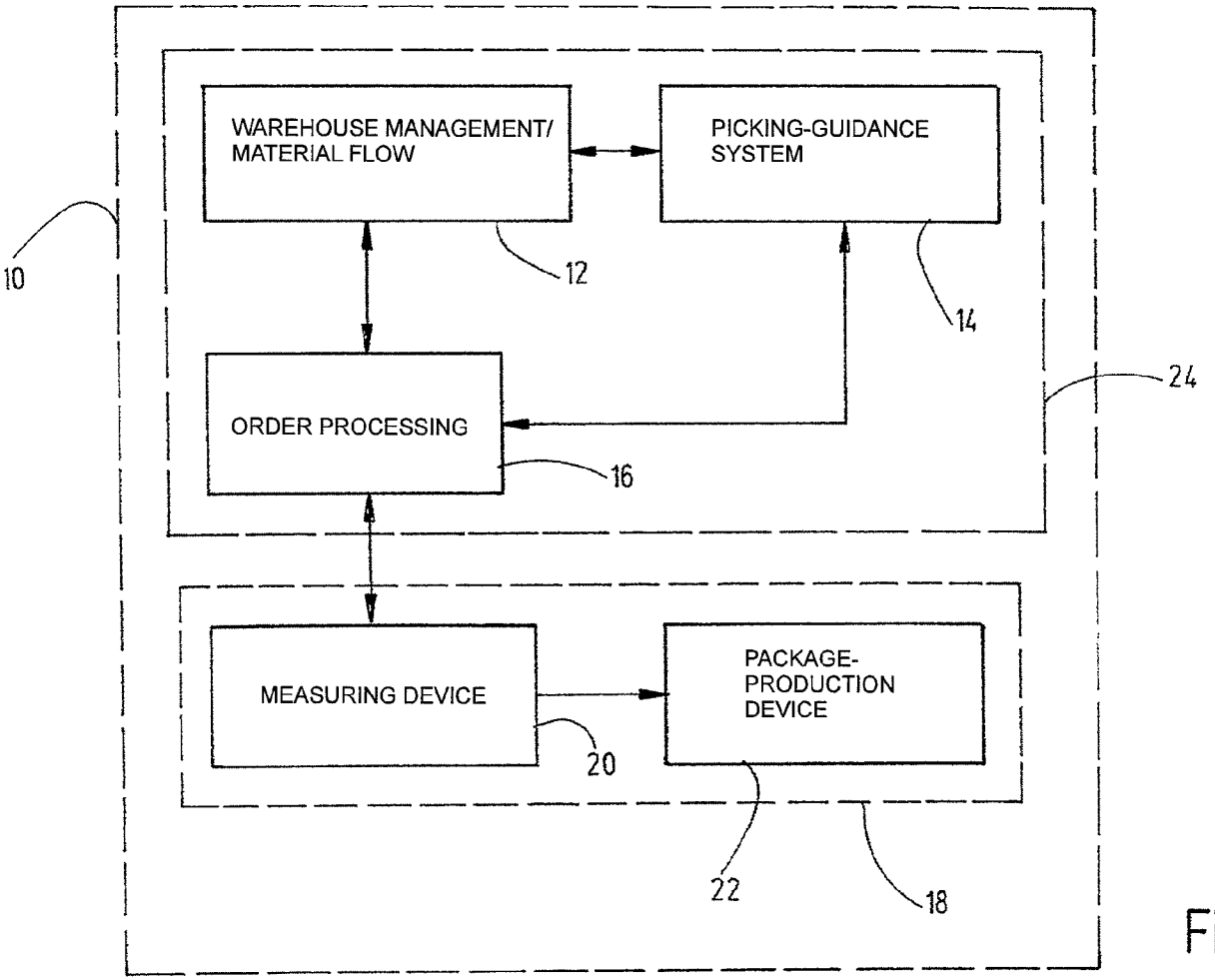
FIG. 1 shows a block diagram of a storage and picking system.

In FIG. 1 a storage and picking system, or a distribution system, 10 is shown. The storage and picking system 10 comprises control components 12 for warehouse management and for regulating material flow. The material flow, as a rule, is handled by conveyors (e.g., belt conveyor, roller conveyor, chain conveyor, overhead conveyor or small belt conveyors, shuttle, storage and retrieval devices, autonomous transport systems) which are not shown. In addition, a picking control system 14 (hardware and/or software) as well as an order processing 16 (hardware and/or software) can be provided. The software can in turn be executed on a central control 24 or decentralized-distributed control components. The warehouse management and the material flow, the picking control system and the order processing communicate data with each other.

The storage and picking system 10 further comprises at least one packing-work station 18 which comprises at least one measuring device 20. Further, the packaging-work station can comprise a package-production device 22. Exemplary measuring devices 20 and package-production devices 22 are described, for example, in WO 2011/072253 A1 and WO 2012/082980 A1. A more detailed description will follow with reference to FIGS. 6 and 7. Another exemplary measuring device 20 is described in U.S. Pat. No. 6,373,579 B1. It is clear that the measuring device 20 and the package-production device 22 can also be bought from other providers in different embodiments.

The control 24 can be connected either wirelessly or via solid lines to the measuring device 20 and the package-production device 22. Articles 26, which are not shown in more detail in FIG. 1, are delivered in huge quantities via a goods receipt to the distribution system 10. The articles are normally conveyed from the goods receipt towards the long-term warehouse. There the articles 26 serve as stock for processing (picking) orders.

An order is formed of one or more order positions which are also called order lines. An order line indicates a respective quantity (number of pieces) of an article type ordered by a customer. The order processing 16 takes care that the articles 26, which are required for satisfying a picking order are present between the individual components of the system 10 right in time and in the right number at the right place, and that articles are re-ordered and the like.

Hereinafter an article 26 is to be understood as a piece good, or a packaging unit. An article 26 is a (smallest) unit of a range of articles which can be distinguished by an article type. Piece goods are individualized distinguishable goods which can be handled individually and a quantity of which is recorded in pieces or as cases or packaging units. A case, or a packaging unit, is to be understood generally as a unit which can be handled individually and which can be moved manually or by means of technical equipment (conveying system). Even a sub-quantity of a load unit such as a box of beverages on a completely loaded palette of boxes of beverages is called a case. In the following the terms "article", "case", "packaging unit", and "piece good" are used equivalently.

Figure 2:
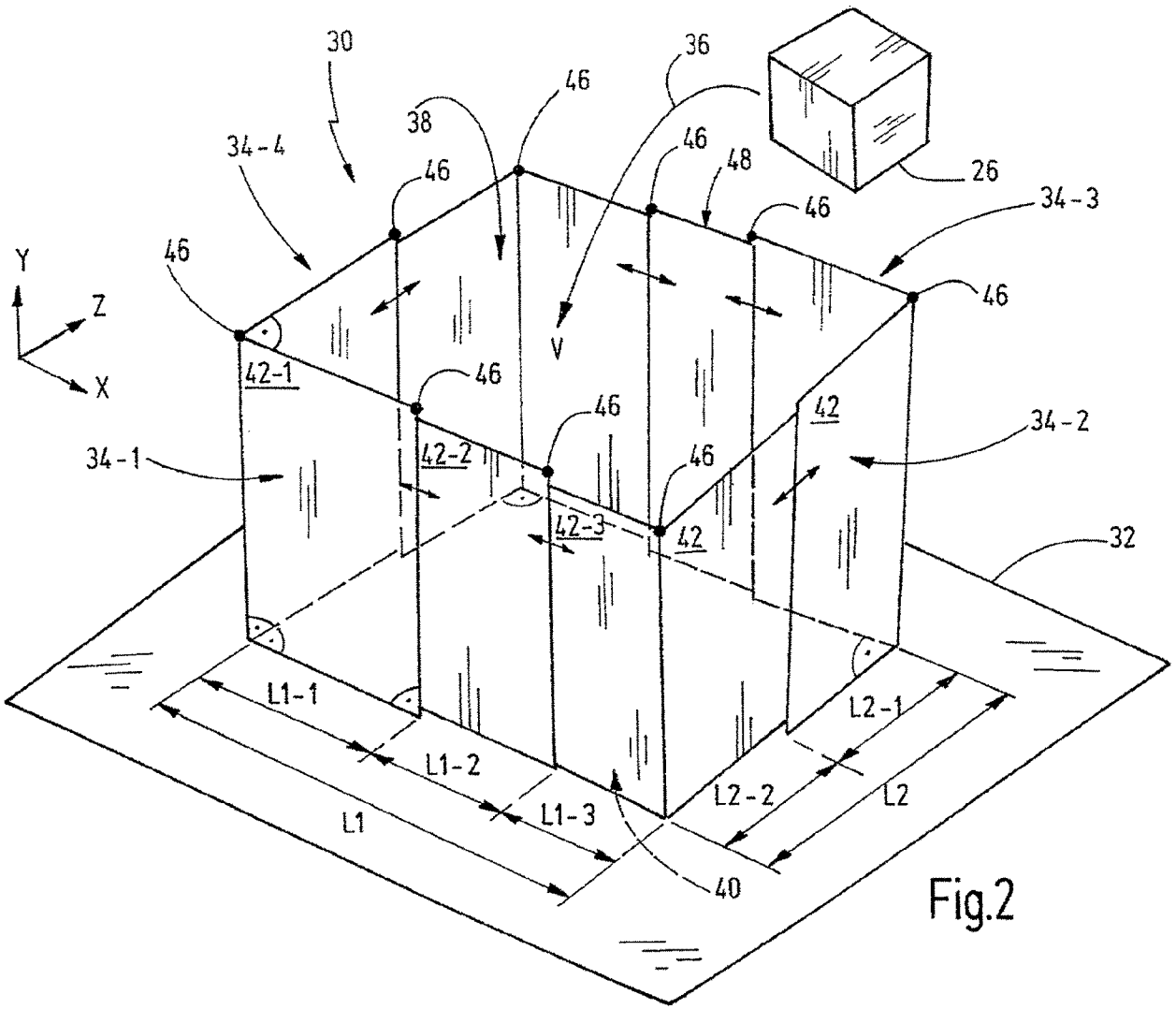
FIG. 2 shows a perspective illustration of a stacking aid on a packing plane.

FIG. 2 shows a perspective view of a stacking aid 30 which is used at a packing-work station 18 which will be described in more detail with reference to FIG. 3. The stacking aid 30 is placed on a packing plane 32 which will also be explained in more detail with reference to FIG. 3. The stacking aid 30 comprises a number of lateral sides 34 which are connected to each other in a circumferential direction (in the plane XZ) in a closed manner. The stacking aid 30 of FIG. 2 comprises four lateral sides 34-1 to 34-4. The stacking aid 30 preferably surrounds a stacking volume V which substantially has the shape of a rectangular parallelepiped and into which the articles 26 can be stacked, as indicated by means of an arrow 36. The stacking volume V is limited in a circumferential direction by the lateral sides 34.

A stacking process is performed through an open top side 38 of the stacking aid 30 by introducing the article 26 of a picking order from above into the interior of the stacking aid in a manual manner (by a packing person) or in an automated manner (by a packing robot) and by stacking the same there. The (entirely) open top side 38 of the stacking aid 30 is limited circumferentially by the lateral sides 34 and is substantially positioned in the plane XZ. A bottom side 40 of the stacking aid 30 is also formed entirely open and is temporarily closed in FIG. 2 by the packing plane 32. The article 26 are primarily placed on the packing plane 32 and secondarily onto each other. In this context, the article 26 are preferably aligned with one corner of the stacking aid which is defined by the lateral sides 34, which are positioned adjacent to each other, and the packing plane 32. The stacking can also be performed against one or more of the lateral sides 34 preventing a collapse of the so-stacked article stack.

The lateral side 34-1 extends substantially in the vertical plane XY. The first lateral side 34-1 is connected, preferably pivotally about the axis Y in a rotating manner, to the second lateral side 34-2 which extends in the vertical plane YZ. The second lateral side 34-2 in turn is connected, preferably pivotally and rotationally about the axis Y, to the third lateral side 34-3 which extends substantially in the plane XY. The third lateral side 34-3 is connected, preferably pivotally and rotationally about the axis Y, to the fourth lateral side 34-4 which extends substantially in the plane YZ. The fourth lateral side 34-4 in turn is connected, preferably pivotally and rotationally about the axis Y, to the first lateral side 34-1. The first lateral side 34-1 substantially extends parallely displaced relative to the third lateral side 34-3. The same applies with regard to the lateral sides 34-2 and 34-4. It is clear that the sides 34 can also be connected rigidly to each other. However, the pivotal connection allows folding of the stacking aid 30 in an unused state in a space-saving manner. However, in order to form a rectangular parallelepiped, at least two corners, which are positioned oppositely in a diagonal direction, must define a right angle, at least during a packing process and until the stacking aid 30 is removed from the shipping carton.

The stacking aid 30 is shown in FIG. 2 in an assembled position which is maximally extended. Each of the lateral sides 34-1 to 34-3 can be adjusted at least in length and is extended maximally in FIG. 2. The first lateral side 34-1 and the third lateral side 34-3 respectively comprise three wall elements 42 which can be extended and retracted. The second and fourth lateral sides 34-2 and 34-4 respectively comprise two wall elements 42 which can be extended and retracted. FIG. 2 merely designates the wall elements 42 of the first and second lateral sides 34-1 and 34-2 in more detail with regard to the wall elements 42. The lengths L1-1 to L1-3 of these wall elements 42 of the first lateral side 34-1 are selected so that they form, in a maximally extended state, the overall length L1 of the first side 34-1. The lengths L2-1 and L2-2 of the wall elements 42 of the second lateral side 34-2 are selected so that they form, in the maximally extended state, the length L2 of the second side 34-2, as shown in FIG. 2. The same applies with regard to the third lateral side 34-3 and the fourth lateral side 34-4. The wall elements 42 can be guided generally in guidances 44 longitudinally displaceable in each other, as exemplarily shown in the sectional view of FIG. 4 for the first lateral side 34-1 of FIG. 2. The guidances 44 can be, for example, rails in which upper and lower edges of the wall elements 42 are displaceably supported. Due to the displacement capability the capability of length adjustments of the sides 34 is ensured.

The wall elements 42 of FIG. 2 are preferably formed in the shape of boards. The wall elements 42 comprise closed surfaces for avoiding lateral dropping of the articles 26 from the stacking aid 30. It is clear that the wall elements 42 can further be formed transparently, for example, by grid structures or the like, in order to be transmissive for laterally incident radiation (e.g., for the purpose of measuring height of the article stack).

The lateral sides 34 further form an upper circulating edge 48 as well as a lower circulating edge 50. At corner points of the upper edge 48, where adjacent lateral sides 34 abut against each other, markers 46 can be provided which cooperate with the measuring device 20 for indicating at least the lengths L1 and L2 of the first lateral side 34-1 and the second lateral side 34-2. Assuming that that the lateral sides 34 limit a rectangular parallelepiped it is sufficient to determine, or measure, the lengths L1 and L2 for determining the smallest packing volume which is defined by a (not shown) article stack being stacked in the interior of the stacking aid 30. For this purpose the sides 34 of the stacking aid 30 are pushed together as far as possible after the stacking of the articles 26, to form an article stack, has been terminated, as will be explained in more detail with reference to FIG. 3.

It is clear that the packing volume V does not need to be formed necessarily as a rectangular parallelepiped. Dependent on the embodiment of the lateral sides 34 also other geometrical shapes can be realized. For example, the wall elements 42 can also be formed round for defining cylindrical packing volumes. Dependent on the shape of the wall elements 42 the markers 46 can also be arranged between adjacent wall elements 42 of one and the same lateral side 34, particularly at the upper edge 48. The sides 34 can be formed respectively by the same number of wall elements 42.

The lateral sides 34 can additionally be formed in a height-adjustable manner, i.e. can be extendable and retractable along the vertical axis Y of FIG. 2. For this purpose again, preferably corresponding, vertical guidances 44 are provided. The height of the stacking aid 30 can be adjusted to a maximum height of the article stack by means of the height-adjustable lateral sides 34.

Figures 3, 4:
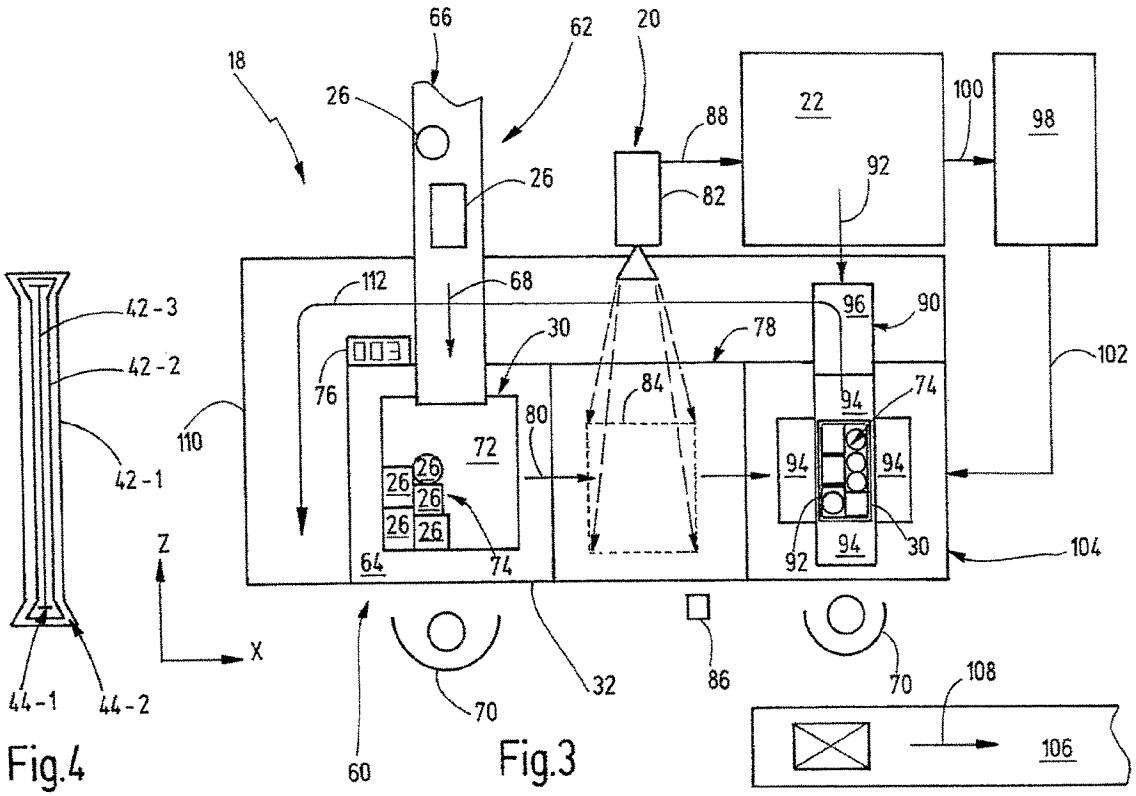
FIG. 3 shows a top view of a packing-work station.
FIG. 4 shows a sectional view through a sidewall of the stacking aid of FIG. 2.

FIG. 3 shows a top view of a packing-work station 18. The packing-work station 18 comprises a packing device 60, an article feed 62, a stacking aid 30, and a measuring device 20. The packing device 60 can be implemented in terms of a table 64, an top side of which forms the (horizontal) packing plane 32. The stacking aid 30 is positioned vertically on the table 64 in an extended state. The article feed 62 is exemplarily implemented as a (belt) conveyor 66 for conveying the article 26 towards the packing device 60, as indicated by an arrow 68. The conveyor 66 is arranged above the stacking aid 30 in a height which allows the packing person 70 to grab the fed articles 26 and to stack them as an article stack 74 in an interior 72 of the stacking aid 30. The packing person 70 orientates the article stack 74, for example, at the left lower corner of the stacking aid 30 of FIG. 3. Further, a display 76 (cf. also picking control system 14) can be provided for indicating to the packing person 70, for example, a number of to-be-stacked articles 26. In the example of FIG. 3 it is shown to the packing person 70 that still three additional articles 26 are to be stacked onto the article stack 74.

Adjacent to the table 64, which represents a packing station, a measuring station 78 is provided so that the packing person 70 can push the stacking aid 30 after a completed stacking process together with the article stack 74 laterally and horizontally onto the measuring station 78, as indicated by means of an arrow 80. The packing person 70 pushes the lateral sides 34 of the stacking aid 30 together for supporting the article stack 74 from each side. The pushing together preferably occurs before the packing person 70 moves the stacking aid 30 together with the article stack 74 from the packing station onto the measuring station 78. By the pushing together of the side 34 of the stacking aid 30 the packing volume of the shipping unit (shipping carton), which is to be produced later, is determined at least in the circumferential direction. The pushing together of the sides 34 of the stacking aid 30 happens before a measuring process, which is performed by the measuring device 20.

The measuring device 20 can be implemented in terms of a camera 82 which is arranged, for example, perpendicularly above the measuring location 78. A field of view 84 of the camera 82 is dimensioned such that the camera 82 can recognize well the sides 34 of the stacking aid 30 even in a maximally extended state thereof. As soon as the stacking aid 30 is positioned together with the contained article stack 74 with maximally pushed together sides 34 on the measuring station 78 measurement of the lengths of the sides 34, preferably of each of the sides 34 of the stacking aid 30, is performed. Measuring process can also be triggered manually by the packing person 70 operating a corresponding actuator 86 (push button, foot switch, or the like). The measuring process can also be triggered in an automated manner by evaluating, for example, a camera image by means of a corresponding image evaluation algorithm. The image of the camera 82 can also be evaluated for determining the lengths of the sides 34 of the stacking aid 30.

It is clear that the measuring device 20 can be arranged also directly in the region of the packing device 60, for example, vertically perpendicular above the table 64. The spatial de-coupling of the packing station from the measuring station 78 has the advantage that during a measuring process already a new article stack 74 can be formed in an other stacking aid 30.

Further, it is clear that the measuring device 20 can also be implemented by location-sensitive reflection sensors or the like which can detect the relative position of the markers 46 (cf. FIG. 2). The measuring device 20 is configured for determining, from the measured lengths, the base area of the stacking aid 30, and thus also the base area of the article stack 74. For this purpose the basic geometry of the stacking aid 30 can be stored as an additional information in terms of data. In the example of FIG. 2 the base area of the stacking aid 30 is a rectangle.

For determining the packing volume it is required to determine a maximum height of the article stack 74. The maximum height of the article stack 74 can either be determined by image-processing algorithms from the image of the camera 82. Alternatively and/or additionally, for example, vertical light grids which are not shown and designated in more detail here can be arranged in the region of the measuring station 78, which light grids are configured for penetrating transparent sides 34 of the stacking aid 30 and for measuring the maximum height of the article stack 74.

From the measured lengths of the sides 34 of the stacking aid 30 as well as the measured or determined (calculated) maximum height of the article stack 74 the volume and the dimensions of the shipping unit can be calculated. This information is transmitted to a package-production device 22 as indicated by an arrow 88. The package-production device 22 produces a package blank 90 and dispenses the same as indicated by an arrow 92. Preferably, the shipping unit has the shape of a rectangular parallelepiped. The package blank 90 comprises a bottom 92, sidewalls 94, and a cover 96, which initially are located in one plane and are cut, for example, from a carton web. Cuttings can be collected in a cuttings storage 98 as indicated by an arrow 100. The cuttings can be used later as filling material before the shipping unit is finally closed. This is indicated in FIG. 3 by an arrow 102.

The stacking aid 30, which has been measured at the measuring station 78, is transferred together with the article stack 74 onto the package blank 90 as shown in FIG. 3 at the right-hand side of the measuring station 78. At the right-hand side of the measuring station 78 a packing station 104 is arranged. It is clear that both the measuring station 78 and the packing station 104 can correspond to the table 64 or the packing device 60. Also, it can be packed, measured, and assembled without lateral displacement at one single location. In this case the spatial de-coupling has the only purpose of de-coupling different stages of the packing process and allowing parallel processing of several shipping units.

As soon as the stacking aid 30 including the article stack 74 is arranged on the bottom 92 of the package blank 90 the sidewalls 94 of the package blank 90 can be folded upwards and connected to each other. In this state the lateral sides 34 of the stacking aid 30 are surrounded supportingly and permanently by the sidewalls 94 of the package blank. In this state the stacking aid 30 can be extracted upwardly from the folded and erected package blank 90. Subsequently a remaining void can be filled optionally with material of cuttings (cf. arrow 102). At the end of the packing process also the cover 96 is connected to one or more of the sidewalls 94. The packing volume is then closed. The so-formed and so-filled shipping unit can then be transported away, for example, via an additional conveyor 106 as indicated by an arrow 108. It is clear that the additional (shipping unit) conveyor 106 can be arranged directly adjacent to the packing station 104 so that the packing person 70 does not need to lift the shipping unit from the packing station 104 onto the conveyor 106. Further, it is clear that a number of buffering locations between the individual stations 60, 68 and 104 can be provided. The transportation of the stacking aid 30 including the article stack 74 can be conducted by additional conveyors. This means that the packing device 60 itself can be implemented by a conveyor. The same applies with respect to the measuring station 78 and the packing station 104.

Further, it is possible to provide a material web, from which the package blank 90 is formed, right from the beginning on the packing plane 32 so that the stacking aid 30 is positioned on the material web during the stacking process. The cutting of the material web occurs later. Then the stacking aid 30 is moved together with the material web towards the package-production device 22 which is arranged downstream.

Figure 5A:
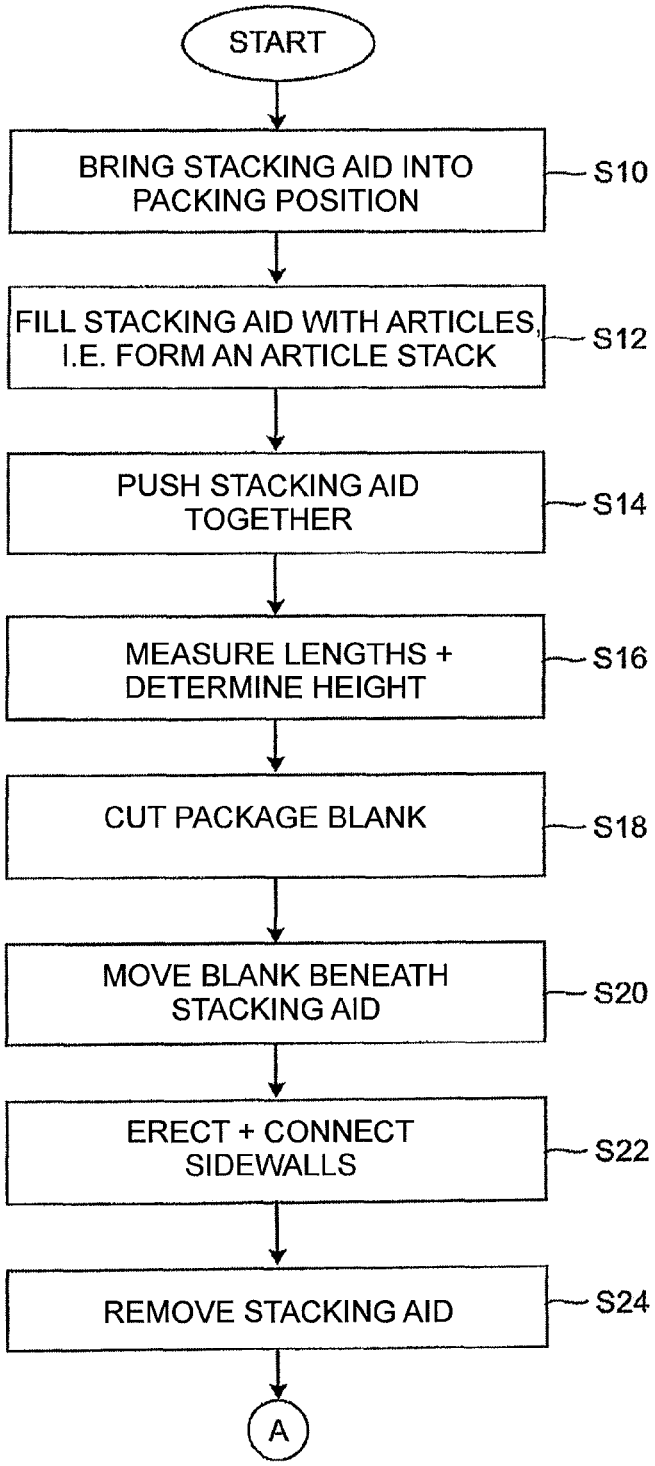
FIGS. 5A and 5B show a flow chart for producing, packing, and shipping a shipping unit, or a shipping carton.
Figure 5B:
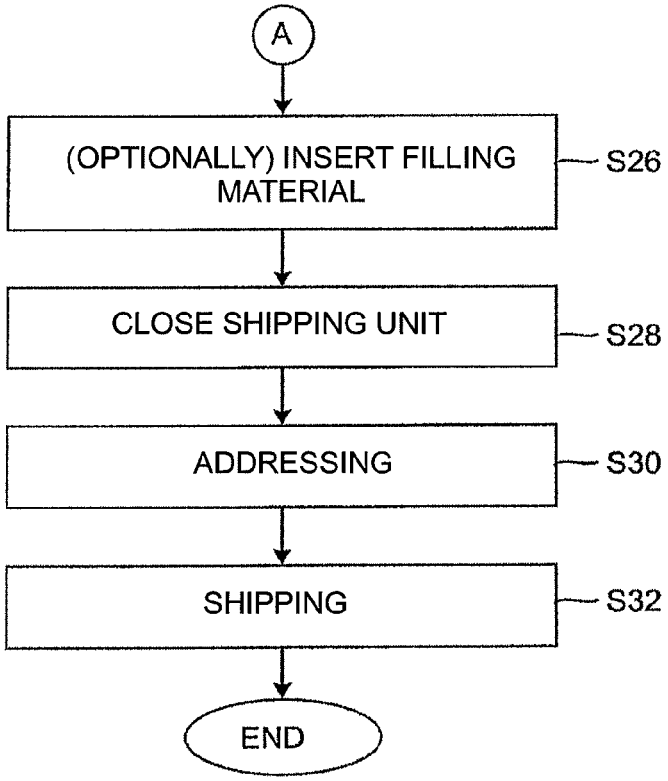

With reference to FIG. 5 hereinafter a method for producing, packing, and shipping a shipping unit (e.g., shipping carton) is explained. In a first step S10 the stacking aid 30 is moved into a packing position (sides 34 are extended) as shown in FIG. 3 at the packing device 60. In step S12 the stacking aid 30 is filled with the articles 26, i.e. an article stack 74 is formed. In step S14 the sides 34 of the stacking aid 30 are pushed together, preferably maximally, for supporting the article stack 74 from each side. In step S16 the lengths L of the sides 34 of the stacking aid 30 are measured. Further, a (maximum) height of the article stack is determined, preferably measured. In step S18 the package blank 90 is cut, preferably from a carton web, by means of the package-production device 22. In step S20 the blank 90 is moved beneath the filled stacking aid 30. In step S22 the sidewalls 94 of the blank 90 are erected and (permanently) connected to each other. In step S24 the stacking aid 30 is removed. In step S26 (optional) filling material is moved into the half-finished shipping carton. In step S28 the shipping unit is closed finally. In step S30 the shipping unit can receive an address. In step S32 the shipping unit having the address can be shipped.

Typically, the steps S10 and 12 and S20 to S32 are performed manually, whereas the remaining steps are performed in an automated manner. However, it is also possible to conduct the steps S20 to S32 in an automated manner. Transporting back of the removed stacking aids 30 to the packing location is typically performed in an automated manner. The steps S10 to S14, however, can also be performed in an automated manner, for example by means of a robot.

It is clear that besides the articles 26 at any time additional elements can be added such as invoices or advertising brochures.

Figure 6:
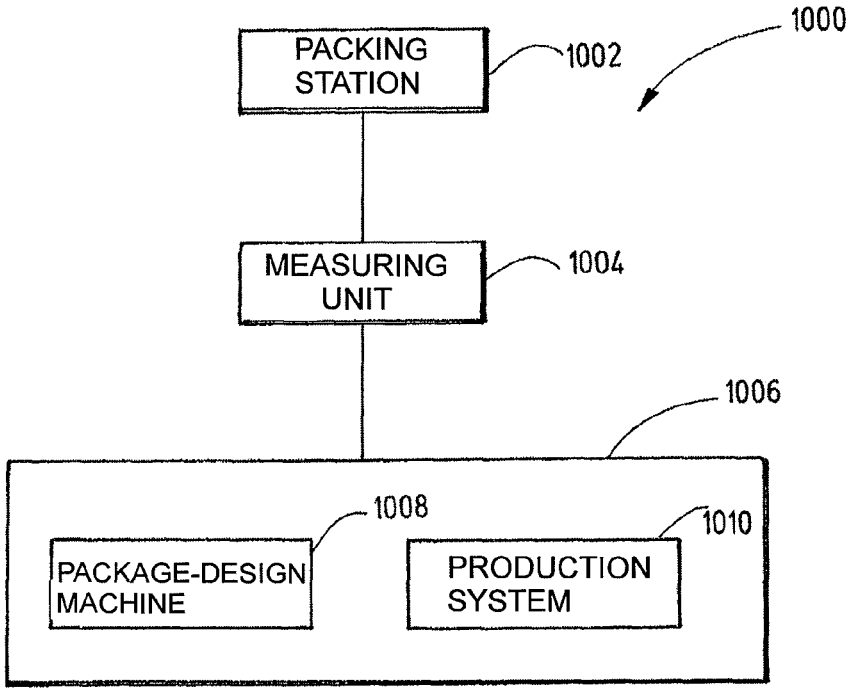
Fig.6 (PRIOR ART)
FIG. 6 shows a block diagram of a conventional system for producing on-demand packages.

FIG. 6 shows a block diagram of a conventional system 1000 for producing on-demand packages. The system 1000 comprises a packing station 1002, a measuring unit 1004, as well as a package-producing machine 1006. The package-producing machine 1006 comprises a package-design machine 1008 as well as a production system 1010. For further details it is referred to the document WO 2012/082980 A1 as mentioned at the outset.

Figure 7:
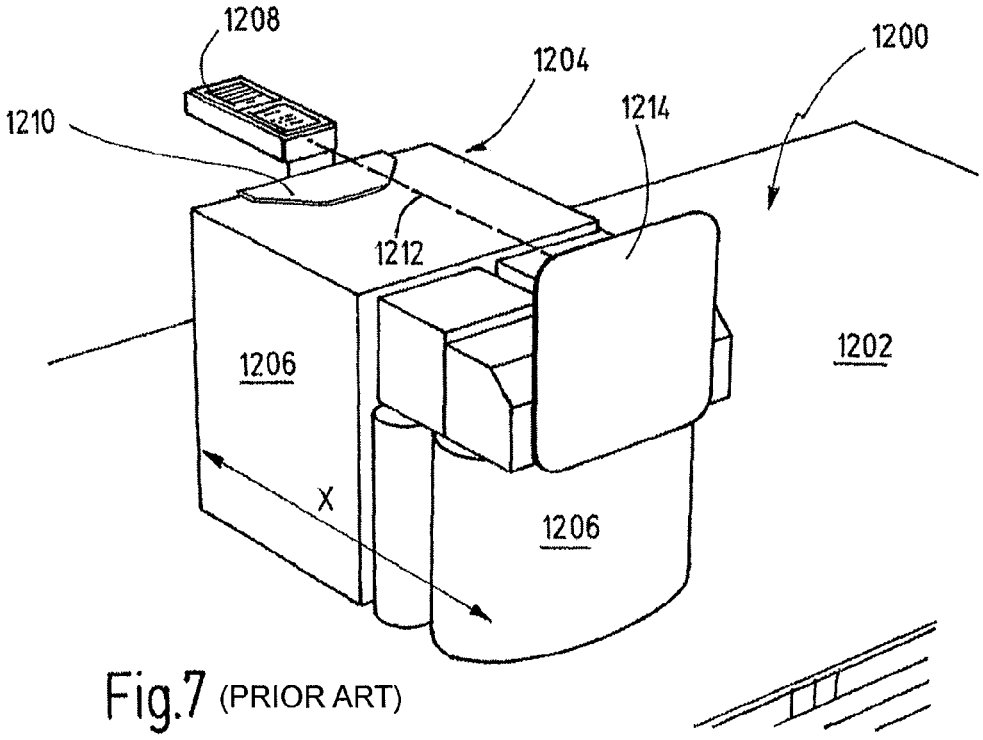
Fig.7 (PRIOR ART)
FIG. 7 shows a conventional packing-work station.

FIG. 7 shows a conventional packing-work station 1200 comprising a table 1202 on which an article stack 1204 is arranged. The article stack 1204 consists of several individual articles 1206 which are stacked to form the stack 1204. One of the articles 1206 is brought into contact with the measuring unit 1004 which was mentioned at the outset. The measuring unit 1004 comprises the above-mentioned hand-held unit 1208 and the angle 1210 attached thereto. The hand-held unit 1208 transmits a (light) beam 1212 which is reflected by the above-mentioned abutting angle 1214 for measuring a length X based on distance.

In the description of the figures above the selection of the orientation of the coordinate system generally equals to the designations which are typically used in warehouse logistics so that a longitudinal direction is designated by X, a transversal direction is designated by Z, and a (vertical) height is designated by Y.

Further, same parts and features have been provided with the same reference numerals. The disclosures contained in the description can be transferred roughly to identical parts and features having the same reference numerals. Position and orientation information (such as "above", "below", "lateral", "longitudinal", "horizontal", "vertical", "circumferential" and the like) refer to the immediately described figure. If the position or orientation is changed this information is to be transferred roughly, however, to the new position or orientation.

REFERENCE NUMERALS

10 storage and picking system
12 WMC/MFC
14 picking control system
16 order processing
18 packing-work station
20 measuring device
22 package-production device
24 control
26 article
30 stacking aid
32 packing plane
34 lateral sides
36 stacking process
38 top side
40 bottom side
42 wall element
44 guidance
46 marker
48 upper edge
50 lower edge
60 packing device
62 article feed
64 table
66 conveyor
68 conveying direction
70 packing person
72 interior of 30
74 article stack
76 display
78 measuring station
80 displacement movement
82 camera
84 field of view
86 actuator
88 data transmission
90 package blank
92 bottom of 90
94 sidewalls of 90
96 cover of 90

98 cuttings storage
100, 102 arrows
104 packing station
106 conveyor
108 arrow
110 conveyor
112 arrow
1000 conventional system
1002 packing station
1004 measuring unit
1006 package-production machine
1008 package-design machine
1010 production system
1200 conventional packing-work station
1202 table
1204 article stack
1206 article
1208 hand-held unit
1210 angle
1212 (light) beam Therefore what we claim is:

1. A packing-work station for packing articles, which belong to one picking order, into shipping units comprising:

a packing device comprising a packing plane on which the articles are stackable to form an article stack;

a manually removable stacking aid having a plurality of lateral sides against which the articles are positioned to form the article stack, wherein the stacking aid is configured to be positioned removably on the packing plane; and a measuring device for determining dimensions of the article stack in order to individually produce the shipping unit in accordance with the so-determined dimensions;

wherein the lateral sides of the stacking aid, which are closed in a circumferential direction of the stacking aid, are connected to each other;

wherein the lateral sides define an open bottom side as well as an open top side of the stacking aid, wherein the lateral sides are configured to be adjustable, by manually pushing the lateral sides together, in length at least along the circumferential direction for positioning the lateral sides circumferentially compact against the article stack; and wherein the measuring device is configured to measure a length of the lateral sides of the stacking aid as well as to determine a maximum height of the article stack, and to transmit the so-determined height as well as the measured lengths to a package-production device which produces the shipping unit in accordance with the measured lengths and the determined height.

2. The packing-work station of claim 1, wherein at least one of the lateral sides is further configured to be adjustable in height, and wherein the measuring device is further configured to measure a height of height-adjustable lateral sides for determining, from the measured height of the lateral sides, the maximum height of the article stack.

3. The packing-work station of claim 1, wherein the lateral sides form upper and lower circulating edges of the stacking aid, wherein the upper and/or lower edge is/are provided with markers at intersection points of the lateral sides.

4. The packing-work station of claim 1, wherein exactly four lateral sides are provided which surround the bottom side and the top side.

5. The packing-work station of claim 1, wherein the lateral sides are pivotally connected to each other for folding the lateral sides, in a unused state of the stacking aid, onto each other in a space-saving manner.

6. The packing-work station of claim 1, wherein each of the lateral sides comprises a guidance as well as at least two wall elements which are supported in the guidance movably in each other in a length-adjustable manner for adjusting the respective lateral side with regard to a length thereof.

7. The packing-work station of claim 1, wherein the lateral sides define flat planes.

8. The packing-work station of claim 1 further comprising a conveyor onto which the article stack is transferable together with the stacking aid and which connects the packing plane to the package-production device, wherein the conveyor is configured to move the layered article stack together with the stacking aid onto a flat package blank which forms, in a folded state, the ship-ping unit and which comprises a bottom, sidewalls, and a cover.

9. The packing-work station of claim 1 further comprising, adjacent to the packing device, a package-material dispenser which is configured to deliver a package-material web onto the packing plane so that the stacking aid is arrangable on the package-material web subsequently.

10. The packing-work station of claim 1 further comprising the package-production device.

11. The packing-work station of claim 1 further comprising an article feed coupled to the packing device for moving the article to the packing plane.

* * * * *